United States Patent [19]

Wood

[11] 4,312,508

[45] Jan. 26, 1982

[54] DICE GAME AND TEACHING AID

[76] Inventor: Michael W. Wood, 1106 Willow Brook Ave., Denham Springs, La. 70726

[21] Appl. No.: 175,065

[22] Filed: Aug. 4, 1980

[51] Int. Cl.[3] ..... A63F 5/04

[52] U.S. Cl. ..... 273/274; 273/146

[58] Field of Search ..... 273/274, 146

[56] References Cited

U.S. PATENT DOCUMENTS 1,481,628 1/1924 Souza ..... 273/146

4,247,114 1/1981 Carroll ..... 273/274

FOREIGN PATENT DOCUMENTS 949733 2/1964 United Kingdom ..... 273/274

OTHER PUBLICATIONS

*A Book on Casino Craps* by C. Ionescu Tulcea, published by Van Nostrand Reinhold, New York, ©1981, pp. 96-102.

*Primary Examiner*—Anton O. Oechsle

*Attorney, Agent, or Firm*—Roy, Kiesel, Patterson & McKay

[57] ABSTRACT

A dice game and teaching aid utilizing three dice, or the mechanical equivalent thereof each dice being tri-colored wherein the numbered sides 1 and 2 are one color, the numbered sides 3 and 4 are a second color, and the numbered sides 5 and 6 are a third color comprising the steps of a player placing at risk some object, rolling the dice and rewarding the player if the dice come up one color or one of each color or all of the color of sides 3 and 4 or all of a particular number or the total in the three numbers rolled is greater than eleven.

3 Claims, 1 Drawing Figure

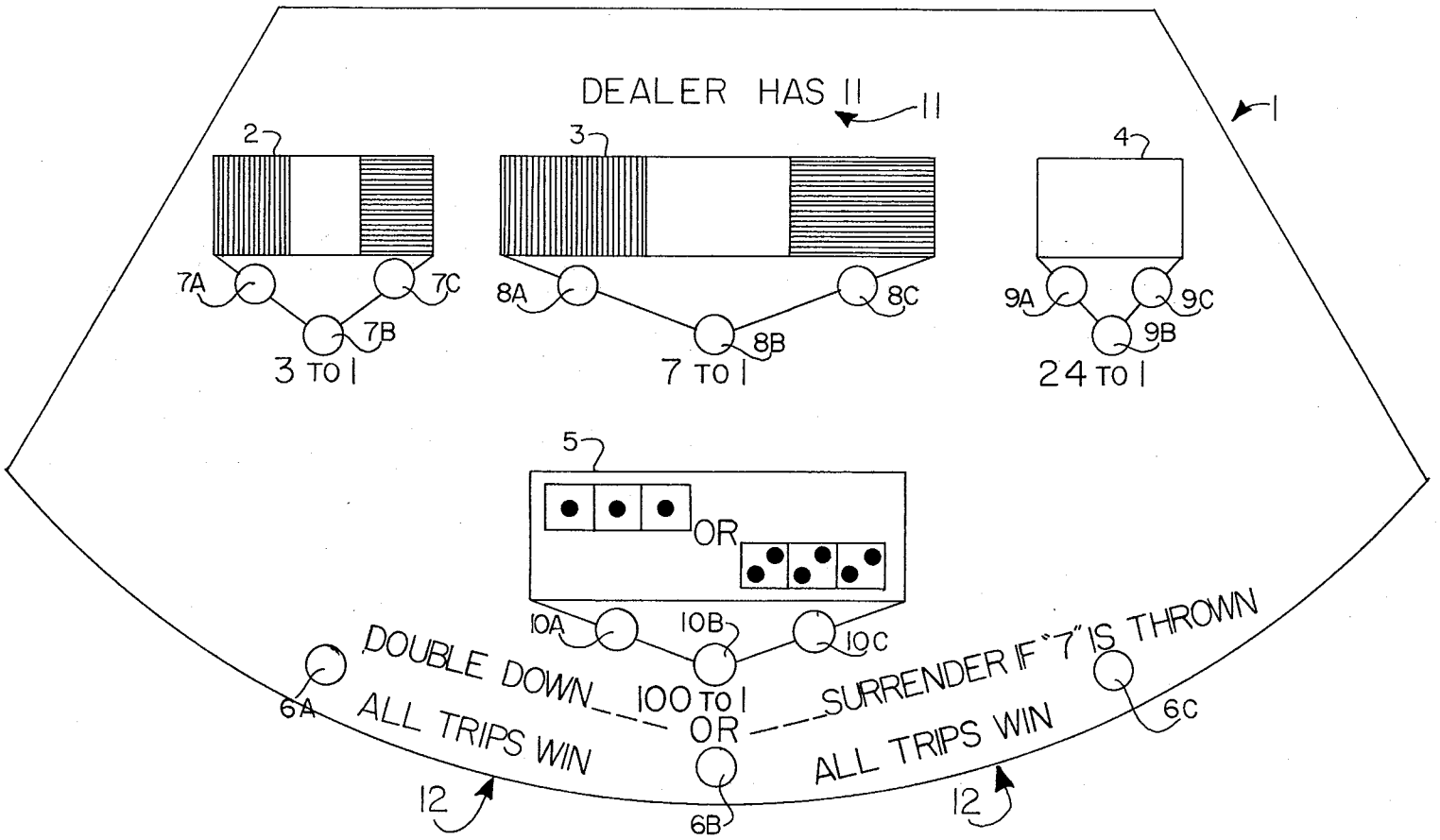
1
DEALER HAS 11
2
3
4
5
7A
7B
7C
3 TO 1
8A
8B
8C
7 TO 1
9A
9B
9C
24 TO 1
10A
10B
10C
OR
100 TO 1
OR
6A
6B
6C
DOUBLE DOWN
ALL TRIPS WIN
SURRENDER IF "7" IS THROWN
ALL TRIPS WIN
12
12

DICE GAME AND TEACHING AID

BACKGROUND OF THE INVENTION

1. Field of the Invention

A dice game utilized for entertainment as well as a teaching aid.

2. Prior Art

Various dice games have long been used as a source of entertainment as well as a method of teaching statistics or permutation. These prior art dice games have traditionally used two dice although in some variations three or more dice have been utilized.

As a game players have traditionally "bet" on the occurance of a particular sequence of numbers rolled on the dice. In most cases the player is allowed a "second line bet" on whether the dice roller will roll his first number again before he rolls either a "7" or "11". There are of course many variations to this basic game relating to payoff odds, etc. However, as a teaching aid these games are restrictive in that the variables have been restricted to number combinations that can be rolled and on the other hand as a game as being perceived as too complex and risky.

SUMMARY OF THE INVENTION

Therefore, it is an object of this invention to provide a dice game that is readily understandable and is simple to play.

Another object of this invention is to provide an aid to teaching statistics, permutation and binary math system.

A further object of this invention is to provide a dice game attractive to a broader spectrum of people.

Other objects and advantages of this invention will become apparent from the ensuing descriptions of this invention.

Accordingly, a dice game utilizing three, tri-colored dice wherein the dice sides representing the numerals 1 and 2 are one color, the dice sides representing the numerals 3 and 4 are a second color and the dice sides representing the numerals 5 and 6 are a third color is provided wherein a player first places at risk some object or objects having a pre-determined value and then rolls the three dice. If the dice numbers rolled total less than eleven, the player loses what he placed at risk. In addition if the player has placed at risk some object of pre-determined value on a possible color combination (i.e., each dice surface rolled being a different color or being all of one color), the player is awarded if the color combination is rolled. Finally, if the dice numbers rolled total seven a fourth dice is rolled. If the new total is greater than eleven then the player is rewarded for his risk, otherwise he loses what he has placed at risk.

BRIEF DESCRIPTION OF THE FIGURE

The FIGURE illustrates a preferred embodiment of this game when applied to a casino-type dice game.

PREFERRED EMBODIMENTS OF THE INVENTION

In a preferred embodiment of this invention the dice game of this invention is played with three, tricolored dice which are coded so the numbered sides 1 and 2 are one color (e.g., red), the numbered sides 3 and 4 are a second color (e.g., white) and the numbered sides 5 and 6 are a third color (e.g., blue). Each player already has or is provided with some value units, such as, points, chips, money, etc. Next the player decided the extend of the risk and the type of risk he wishes to take. In this game there are two basic variables: colors and numbers.

The player initially decides whether he wishes to risk his value units on the probability that certain numbers and/or colors will be rolled. Once that decision has been reached, the dice are rolled. The actual setting of which color and/or number combinations will be rewarded and the extent of the reward can be varied, but in all cases is pre-set before the player has decided the extent of the risk he wishes to take. Thus, in a war simulation game format color and/or number combination might represent enemy positions or forces and the value units the players own arm forces. Since the format of the game can be quite varied and without intention of limiting the scope of this invention, the preferred embodiments will be described utilizing a casino dice game format.

Turning now to the FIGURE, a game board layout 1 is shown wherein the color combinations to be awarded are shown: rectangle 2 (a red, white and blue dice are rolled), rectangle 3 (all three dice rolled are one color) and rectangle 4 (all three dice rolled are the color white). In addition layout 1 provides for a special reward for a particular number combination shown in rectangle 5 (all three dice rolled are ones or twos). The game board layout 1 also illustrates the amount of reward to be paid; i.e., 3 to 1, 7 to 1, 24 to 1 and 100 to 1, respectively.

In a preferred embodiment layout 1 will have designated basic player betting spots 6 for the player to place his bets. In the particular layout shown spots 6A, 7A, 8A, 9A and 10A are reserved for a particular player to place his bets. Also shown are spots for two more players 6B–10B and 6C–10C are shown although more could be provided for. In addition, layout 1 can be provided with various playing instructions 11 or other winning combination information 12.

To begin the game the player places the bets of his choosing in spots 6. The dice are then rolled. The player is first rewarded for any winning color combination he has bet. Next, he is rewarded for any special number combination bet and found in rectangle 5 or information 11. After initial winnings are paid, the player also wins if the numbers rolled add up to more than eleven. If the total is less than eleven the player loses his bet made in spot 6. However, in a preferred embodiment if the total is seven a fourth dice is rolled. If the new four dice total is greater than eleven then the player wins his bet made on spot 6. If the four dice total is exactly eleven, the bet is considered a tie and the player is returned his bet.

In a more preferred embodiment the player can win on the second roll of the dice when an seven was first thrown only if he is willing to double his bet. Otherwise, he loses his bet.

In still another preferred embodiment, the player is allowed to place a second bet of the same or less value in spots 7 and/or 9 even after he has lost his first bet when the following conditions occur: the three dice rolled totaled the number seven, the player initialy had a first bet in spots 7 and/or 9, and the player makes a second bet on spot 7 equal to his first bet on spot 6.

In another preferred embodiment a player is allowed to roll the dice until he loses his spot 6 bet. At that time another player gets to roll the dice.

As can be seen, this dice game differs significantly from previous dice games and as a teaching aid increases the amount and type of subject matter taught by introducing the two variables: color and numbers. There are of course many variations of the game not specifically disclosed such as its mechanical adaptation but which are intended to be included in the scope of the invention as defined by the following Claims.

What I claim is:

1. A dice game for players utilizing three, tri-colored dice or their mechanical equivalent, which are coded so that their sides with numerals 1 and 2 are one color, their sides with numerals 3 and 4 are a second color, and their sides with numeral 5 and 6 are a third color, which comprises:

(a) setting rewards on certain color and number combinations that can exist when said dice are rolled, wherein one of said number combinations is the total of the numerals coming up when said dice are rolled is greater than eleven, referred to as a basic combination;

(b) said players indicating which of said combinations will exist on the next roll of said dice and how much risk each of said players will take on each of said combinations, wherein said players being required to indicate a risk on said basic combination;

(c) rolling said dice;

(d) rewarding said players in an amount determined by said rewards and said risk; and (e) wherein if said total is seven, a fourth dice is rolled and wherein if the new four dice total is greater than eleven, rewarding said players in said amount.

2. A dice game according to claim 1, wherein said player must double his risk on said basic combination prior to said fourth dice roll or lose his initial risk on said basic combination.

3. A dice game according to claim 1, wherein said player prior to said fourth dice roll may place at risk a second amount of equal or less value on said color combination on which said player has previously indicated a risk would be taken.

* * * * *